US005171079A

United States Patent [19]

Bayerle

[11] Patent Number: 5,171,079

[45] Date of Patent: Dec. 15, 1992

[54] FIRE EXTINGUISHER CABINET

[75] Inventor: Kirby J. Bayerle, Eden Prairie, Minn.

[73] Assignee: J. N. Johnson Company, Inc., Bloomington, Minn.

[21] Appl. No.: 669,870

[22] Filed: Mar. 15, 1991

[51] Int. Cl.[5] ..... A47B 81/00

[52] U.S. Cl. ..... 312/409; 312/400

[58] Field of Search ..... 312/406, 409, 400, 242; 109/80; 169/51

[56] References Cited

U.S. PATENT DOCUMENTS

| | | | |
|---|---|---|---|
| 1,543,349 | 6/1925 | Walker | 312/406 |
| 3,067,822 | 12/1962 | Hattenhauer . | |
| 3,220,791 | 11/1965 | Pokryfke et al. . | |
| 3,722,733 | 3/1973 | Neumann . | |
| 3,989,329 | 11/1976 | Benford | 312/406 |
| 4,034,697 | 7/1977 | Russell . | |
| 4,046,439 | 9/1977 | Lee . | |
| 4,272,137 | 6/1981 | Rothhaas et al. | 312/409 |
| 4,449,588 | 5/1984 | Benlolo et al. . | |
| 4,763,732 | 8/1988 | Neal . | |

*Primary Examiner*—Gerald A. Anderson

*Attorney, Agent, or Firm*—Palmatier & Sjoquist

[57] ABSTRACT

An improved fire-extinguisher cabinet for insertion into a vertical wall surface consisting of double fire wall cabinets creating an internal cavity which hold a fire-retardant material. The improved double-walled fire extinguisher cabinet satisfies all the requirements of the Uniform Building Code 43-6 "Fire Tests of Through-Penetration Fire Stops" based on ASTM 81-4-83 of the Warnock Hersey International (WHI) of Middleton, Wis., test label for 1- and 2-hour combustible and non-combustible walls. When installed and exposed to a fire the improved double-walled extinguisher cabinet will not permit and/or will retard the spreading of the fire at the installation sight. In addition, the improved double-walled fire extinguisher cabinet provides a convenient, easily accessible, cabinet for containment of a fire-fighting apparatus. The improved fire extinguisher cabinet does not require installation of any special fire-retardant material surrounding its location; all such required safety capacity is built directly into the improved fire extinguisher cabinet.

6 Claims, 3 Drawing Sheets

FIRE EXTINGUISHER CABINET

BACKGROUND OF THE INVENTION

The present invention embodies an improved fire extinguisher cabinet for installation in rooms, corridors or hallways of buildings. The invention improves the fire safety level of the building. The invention is easily accessible, visible, and aesthetically pleasing, and used for holding fire-fighting apparatus and equipment. The invention is intended to be at least partially recessed and mounted into a vertical wall surface.

Prior art fire extinguisher cabinets mounted into a fire wall surface may breach the integrity of the fire wall system, thereby undermining the safety of a building's fire prevention program, because a fire could pass more easily through a fire extinguisher cabinet than through the basic fire wall. The present invention is an improvement over the prior art, where installation of the improved fire extinguisher cabinet will not compromise the integrity of a fire-rated wall system and will maintain the soundness of a building's fire safety scheme.

Prior art fire extinguisher cabinets were not vigorously evaluated or tested in order to obtain information as to the cabinet's fire safety rating. An architect or builder was unable to evaluate the fire safety capabilities of a recessed fire extinguisher cabinet when planning a building's fire prevention program. The present invention has been vigorously evaluated and has successfully passed the tests for 1- and 2-hour combustible and noncombustible fire barrier wall systems.

SUMMARY OF THE INVENTION

An improved fire extinguisher cabinet for insertion into a vertical wall surface consisting of double fire wall cabinets which define an internal cavity containing a fire-retardant material. The improved double-walled fire extinguisher cabinet satisfies all the requirements of the Uniform Building Code 43-6 (Fire Test of Through-Penetration Fire Stops) based on ASTM 814-83 of the Warnock Hersey International (WHI) of Middleton, Wisconsin, test label for 1- and 2-hour combustible and noncombustible wall systems. When installed and exposed to a fire, the improved double-walled fire extinguisher cabinet will not permit and/or will retard the spreading of the fire through the fire extinguisher cabinet. In addition, the improved double-walled fire extinguisher cabinet provides a convenient, easily accessible, cabinet for holding a fire extinguisher.

A feature of the present invention is the double-walled cabinet design which creates a cavity for holding a fire-retardant material.

Another feature of the present invention is the ease of installation of a fire-retardant material into the cavity, and the ease of assembly of the improved double-walled fire extinguisher cabinet.

Still another feature of the present invention is the lack of a requirement for a fire wall barrier, behind the improved double-walled fire extinguisher cabinet, prior to installation of the cabinet into a wall surface.

DETAILED DESCRIPTION OF THE PREFERRED EMBODIMENT

One form of the invention is illustrated and described herein. The improved double-walled fire extinguisher cabinet is indicated in general by the numeral 10.

Figure 1:
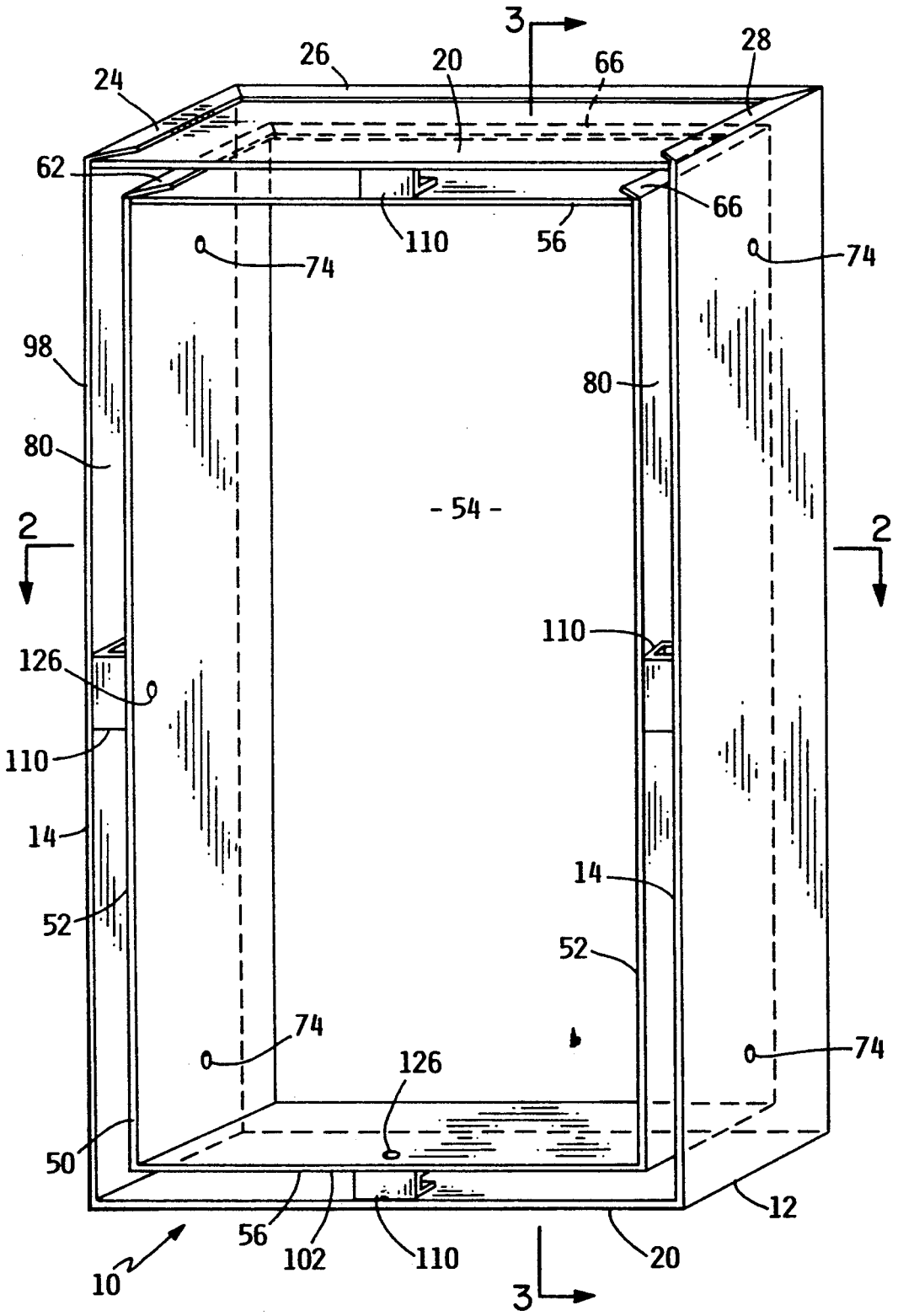
FIG. 1 is an isometric view of the improved fire extinguisher cabinet without a front cover, and without inserted material, showing the double tub design.

FIG. 1 shows the double tub design of the fire extinguisher cabinet 10. The outer tub 12 is comprised of twenty-two gauge cold rolled steel sheet metal with an open front side. The outer tub 12 is generally a rectangular box shape, with a pair of substantially flat sides 14, and back side 16. The sides 14 depend forwardly from the back side 16 as do the top and bottom panels 20. The top and bottom panels 20 connect between the sides 14 at the upper and lower ends thus defining the outer tub 12 containment area.

Upper flange portions 24, 26, 28 are located on the upper end of the sides 14 and back side 16 respectively. Corresponding lower flange portions are located on the lower end of the sides 14 and back side 16 respectively. The upper and lower flange portions depend in a perpendicular direction from the sides 14 and back side 16 into the interior of the outer tub 12. The top panel 20 is affixed to the interior of the top flange portions 24, 26, 28 by welding. The bottom panel 20 is affixed to the interior of the bottom flange portions by welding.

The sides 14 and back side 16 are formed by bending the cold rolled steel sheet metal into the desired shapes. Top and bottom flange portions 24–34 are formed by bending and cutting the sides 14 and back side 16 respectively into the desired shapes.

The outer tub 12 is preferably electrostatically coated with epoxy paint.

Preferably the outer tub 12 dimensions will vary between 25 and 34 inches in height, 12 and 29 inches in width, and 4 and 8 inches in depth respectively.

The inner tub 50 is comprised of twenty-two gauge cold rolled steel sheet metal with an open front side. The inner tub 50 is also a generally rectangular box shape with a substantially flat pair of sides 52, and back side 54. The sides 52 depend forward from the back side 54 as do the top and bottom panels 56. The top and bottom panels 56 traverse between the sides 52 at the upper and lower ends thus defining the inner tub 50 containment area.

Upper flange portions 62, 64, 66 are located on the upper end of the sides 52 and back side 54 respectively. Corresponding lower flange portions are located on the lower end of the sides 52 and back side 54 respectively. The upper and lower flange portions depend in a perpendicular direction from the sides 52 and back side 54 into the interior of the inner tub 50. The top and bottom panels 56 are affixed to the interior (of the inner tub 50) by welding. The top panel 56 is welded to the interior of the top flanges 62, 64 and 66. The bottom panel 56 is welded to the interior of the bottom flanges.

The sides 52 and back side 54 are formed by bending of the cold rolled steel sheet metal into the desired shapes. The top and bottom flange portions are formed by bending and cutting of the interior sides 52 and back side 54 into the desired shapes.

The inner tub 50 is preferably electrostatically coated with epoxy paint.

Preferably the inner tub 50 dimensions will vary between 24 and 33 inches in height, 11 and 28 inches in width, and 3 and 7 inches in depth, respectively. In all cases the size of the inner tub 50 is made so as to permit nexting into the outer tub 12.

The cavity 80 is defined by the open space area between the outer tub 12 and the inner tub 50. In more detail, the cavity 80 exists between the pair of sides 14 of the outer tub 12, and the pair of sides 52 of the inner tub 50. In addition, the cavity 80 exits between the back sides 16, 54, and top and bottom panels 20, 56 of the outer tub 12 and the inner tub 50 respectively. Preferably the size of the cavity 80 will be about ¾ inch between the sides, back, and top and bottom panels of the outer tub 12 and the inner tub 50.

Figure 2:
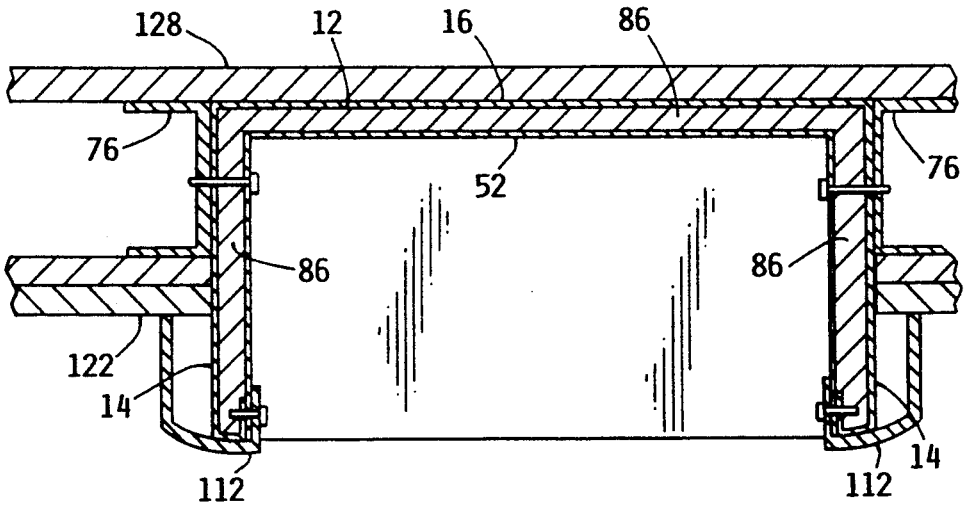
FIG. 2 is a partial cross-section view taken along the line 2—2 of FIG. 1, and showing the cabinet installed in a wall.
Figure 3:
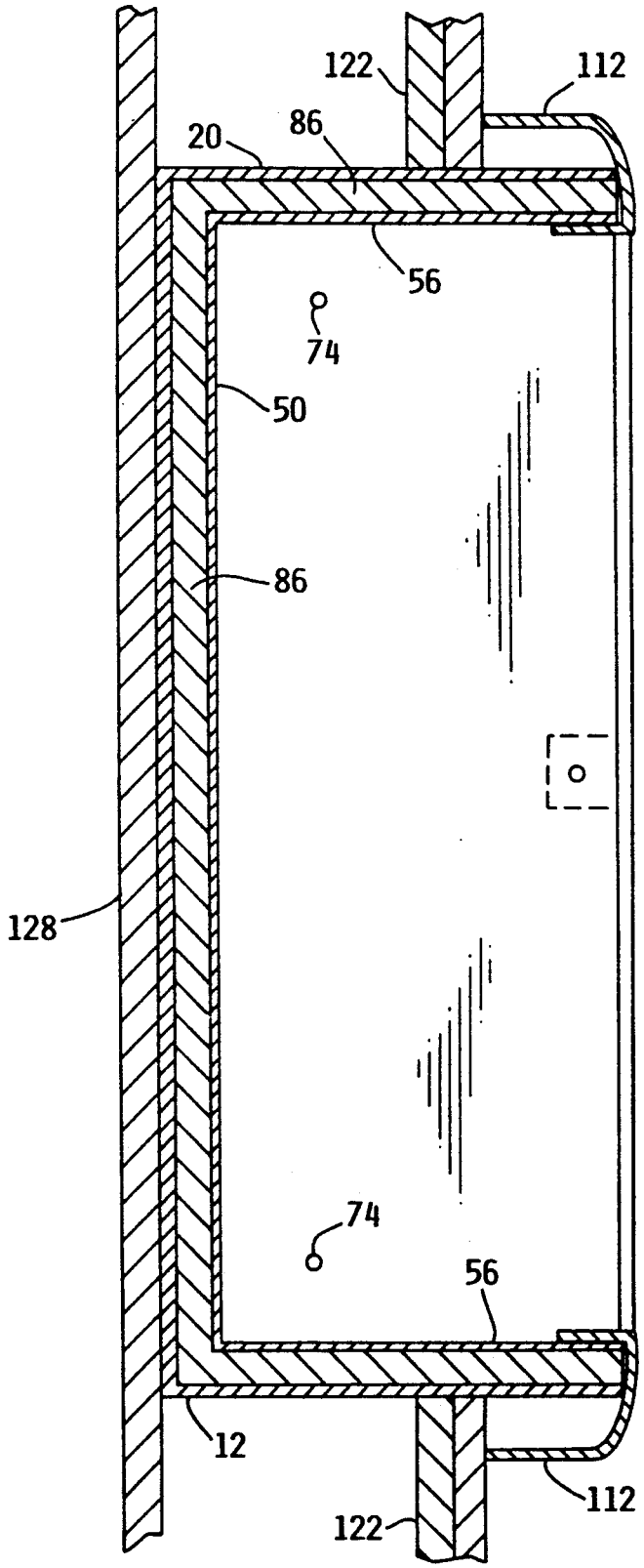
FIG. 3 is a partial cross section view taken along the line 3—3 of FIG. 1, and showing the cabinet installed in a wall.

Fire-retardant material is cut and/or placed so as to completely fill the cavity 80. Specifically, FIGS. 2 and 3 show a fire-retardant material 86 contained in the cavity 80. The fire-retardant material 86 is preferably about ⅝ inch in thickness and comprised of an X-type gypsum, fiberglass, or any other conventional fire-retardant material which will satisfy the standards for fire through penetration for 1- and 2-hour combustible wall systems.

The fire-retardant material 86 is preferably installed in the cavity 80 by insertion of a back portion, into the interior of the outer tub 12, so that the back portion, fits precisely into, and abuts flush against, the entire inner surface of the back side 16. Two side portions of the fire-retardant material 86 are inserted into the interior of the outer tub 12, so that the side portions fit precisely into, and abut flush against, the interior surfaces of the pair of sides 14 respectively as seen in FIG. 2. The two side portions will be of equal height depending from the interior of the top panel 20, to the interior of the bottom panel 20, of the outer tub 12. FIG. 2 shows that the two side portions will remain of equal depth, and depend forward from the back portion to the front edges 98 of the sides 14 of the outer tub 12. FIG. 2 also shows a representative front cover 112 attached to cabinet 10.

FIG. 3 shows top and bottom portions, of fire-retardant material 86, located in the cavity 80 above and below the top and bottom panels 56 of the inner tub 50. The top and bottom portions will depend forward from the back to the front edges of the top and bottom panel portions 20 of the outer tub 12. The top and bottom portions will traverse between the pair of side portions.

FIGS. 2 and 3 show that the back portion, the pair of side portions, and the top and bottom portions of the fire-retardant material 86 will suitably fill the cavity 80. The double-walled fire cabinet 10 will then be assembled by the insertion of inner tub 50, into the space defined by the portions of the fire-retardant material 86.

Figure 4:
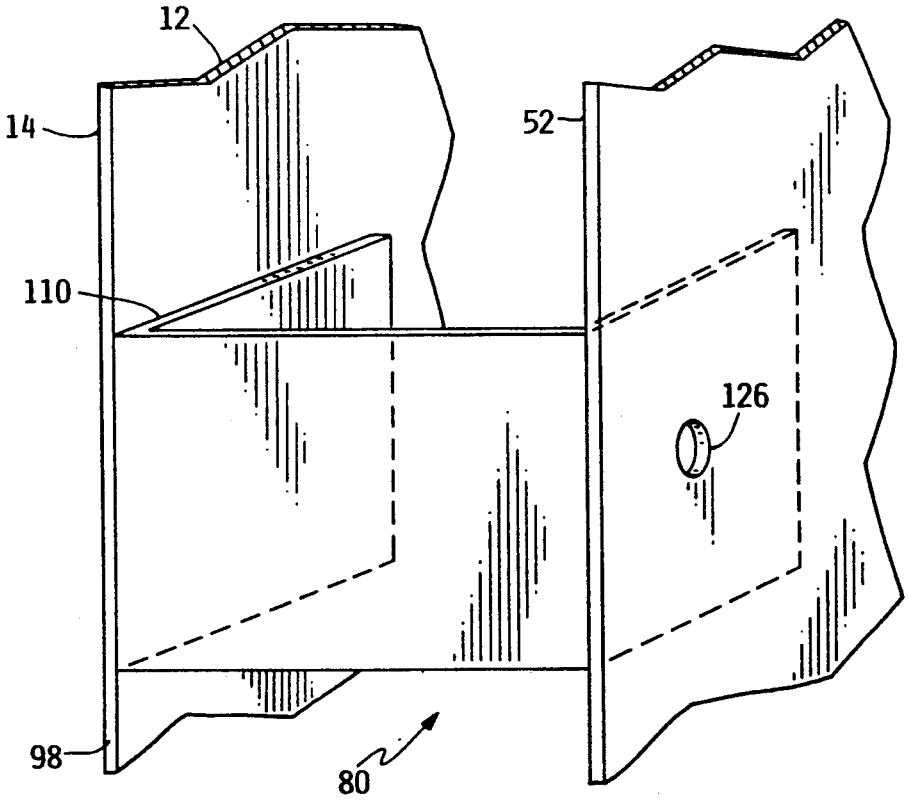
FIG. 4 is an exploded view of a positive spacer.

FIG. 1 and the expanded view of FIG. 4 shows a plurality of positive spacers 110 affixed to the interior of the pair of sides 14 and top and bottom panels 20 of the outer tub 12. The spacers 110 are suitably affixed to the outer tub 12 by spot welding. The spacers 110 are comprised of a portion of steel sheet metal. The spacers 110 serve as a means for confining the fire-retardant material 86 inside the cavity 80. The plurality of positive spacers 110 bend 90° at the front edges of the pair of sides 14, and top and bottom panels 20, of the outer tub 12 respectively. The spacers 110 traverse the cavity 80 and have a reverse bend for flush contact with the outer surface with the pair of sides 52 and top and bottom panels 56 of the inner tub 50. As shown in FIG. 4, each of the spacers 110 may contain an opening aligned with hole 126 for use in securing the fire-retardant material 86 into a desired position. The plurality of positive spacers 110 are also electrostatically finished with the use of epoxy paint.

The plurality of openings 126 through sides 52 and top and bottom panels 56 of the inner tub 50 are adapted for use in securing the inner tub 50 to the positive spacers 110 and also to the fire-retardant material 86.

Screws, preferably self-tapping, may be inserted through the openings 126, and into the fire-retardant material 86.

FIGS. 1 and 3 show a plurality of attachment openings 74 preferably aligned through the pair of sides 14 and 52 of the inner and outer tubs 12, 50 respectively. The attachment openings 74 are adapted for use in securing the cabinet to the wall studs 76.

FIG. 2 shows the improved fire extinguisher cabinet 10 mounted into a recessed wall surface 122 by any conventional means including the use of, self-tapping screws or bolts, inserted through the attachment openings 74 into wall studs 76.

The erection of a fire wall 128 immediately behind the double-walled fire extinguisher cabinet 10, when mounted in a recessed wall surface 122, is not required in order to maintain the integrity of a fire barrier wall system. The double-walled fire extinguisher cabinet 10, satisfies the Uniform Building Code 43-6 (Fire Test of Through-Penetration Fire Stop) based on ASTM 814-83 of the Warnock Hersey International (WHI) of Middleton, Wisconsin, test label for 1- and 2-hour combustible and noncombustible wall systems.

A face plate or cover 112, as known in the art, is suitably used for mounting over the double-walled fire extinguisher cabinet.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An improved double-walled fire extinguisher cabinet comprising:

(a) an outer cabinet having a rear wall and four sidewalls joined together to form an interior right angle bend between said rear wall and each of said four sidewalls, thereby forming an enclosure having an open front; a plurality of U-shaped spacers welded to the interior surfaces of said sidewalls, each spacer having a bridging portion extending inwardly proximate said open front and having an inner leg extending into said enclosure from said bridging portion, each said inner leg having a hole therethrough;

(b) an inner cabinet having a rear wall and four sidewalls, nested into said outer cabinet to contact the respective inner legs of said spacers to thereby provide a continuous cavity between the outer cabinet and the inner cabinet; a plurality of holes through the respective sidewalls of said inner cabinet, each hole alignable with a corresponding hole in an inner leg;

(c) a fire-retardant material filling the continuous cavity between the inner and outer cabinet, and extending to the bridging portion of said U-shaped spacers;

(d) an enlarged cover sized to overlay said continuous cavity at said enclosure open front, and having inwardly directed tabs with holes alignable with said inner cabinet holes; and (e) self-threading fasteners secured through the aligned holes of said cover and inner cabinet sidewalls and said spacer inner legs, and engaging into said fire-retardant material.

2. The apparatus of claim 1, wherein said fire-retardant material further comprises material selected from the group consisting of type X gypsum, and fiberglass.

3. The apparatus of claim 1, further comprising a front panel affixed across the open front of said outer cabinet.

4. The apparatus of claim 3, wherein said front panel further comprises a door.

5. An improved double-walled fire extinguisher cabinet comprising:

(a) an outer rectangular enclosure having one open side;

(b) an inner rectangular enclosure having one open side, said inner enclosure positioned inside said outer enclosure with the respective open sides aligned and positioned to provide a continuous cavity between the outer enclosure and the inner enclosure and said cavity having one open side corresponding to said aligned open sides of said inner and outer enclosures;

(c) a fire-retardant material filling the cavity;

(d) a plurality of spacers fixed to the outer enclosure and transversing the cavity, said spacers having an inwardly directed tab contacting said inner enclosure;

(e) an outer cover said sized to overlay cavity one open side, said cover having an interior peripheral flange sized to fit inside said inner enclosure;

(f) a plurality of alignable holes through said flange, said inner enclosure and said spacer inwardly directed tabs, and a plurality of self-threading fasteners secured through said alignable holes and engaging said fire retardant material.

6. The apparatus of claim 5, wherein said fire-retardant material further comprises material selected from the group consisting of type X gypsum, and fiberglass.

* * * * *

UNITED STATES PATENT AND TRADEMARK OFFICE

CERTIFICATE OF CORRECTION

PATENT NO. : 5,171,079

DATED : December 15, 1992

INVENTOR(S) : Kirby Bayerle

It is certified that error appears in the above-identified patent and that said Letters Patent is hereby corrected as shown below:

In claim 5, column 6, line 12, "said" should be deleted.
In claim 5, column 6, line 12, "overlay cavity one" should read -- overlay said cavity one --.

Signed and Sealed this

Twenty-sixth Day of October, 1993

*Attest:*

*Attesting Officer*

Bruce Lehman

BRUCE LEHMAN

*Commissioner of Patents and Trademarks*